United States Patent [19]

Miura et al.

[11] Patent Number: 4,933,007

[45] Date of Patent: Jun. 12, 1990

[54] HEAT-RESISTANT ALUMINUM-BASE COMPOSITES AND PROCESS OF MAKING SAME

[75] Inventors: Tsunemasa Miura; Koichiro Fukui, both of Oyamashi, Japan

[73] Assignee: Showa Aluminum, Osaka, Japan

[21] Appl. No.: 424,082

[22] Filed: Oct. 19, 1989

[30] Foreign Application Priority Data

Oct. 21, 1988 [JP] Japan ..... 63-266876

[51] Int. Cl.[5] ..... C22C 29/12

[52] U.S. Cl. ..... 75/235; 75/236

[58] Field of Search ..... 75/235, 236

[56] References Cited

U.S. PATENT DOCUMENTS

| | | | |
|---|---|---|---|
| 4,623,388 | 11/1986 | Jatkar et al. | 75/232 |
| 4,624,705 | 11/1986 | Jatkar et al. | 75/239 |
| 4,735,656 | 4/1988 | Schaefer et al. | 75/238 |
| 4,832,734 | 5/1989 | Benn et al. | 75/249 |

*Primary Examiner*—Stephen J. Lechert, Jr.
*Assistant Examiner*—Leon Nigohosian, Jr.
*Attorney, Agent, or Firm*—Tilton, Fallon, Lungmus & Chestnut

[57] ABSTRACT

A heat-resistant aluminum-base composite which includes an aluminum matrix of not smaller than 99.0% purity, Si particles whose average diameter falls in the range of 0.1 to 100 $\mu$m, and $Al_2O_3$ and $Al_4C_3$ particles, the particles being dispersed in the aluminum matrix at volume percents Vf(Si) and $V_f(Al_2O_3+Al_4C_3)$ wherein $Vf(Si) \geqq 9\%$, $Vf(Al_2O_3+Al_4C_3) \leqq 20\%$ and $Vf(Al_2O_3+Al_4C_3)+Vf(Si) \leqq 40\%$.

3 Claims, No Drawings

HEAT-RESISTANT ALUMINUM-BASE COMPOSITES AND PROCESS OF MAKING SAME

BACKGROUND OF THE INVENTION

The present invention relates to a heat-resistant aluminum-base composite and process of producing same, the composite being adapted for making components for internal combustion engines such as pistons, and more particularly to a heat-resistant aluminum-base composite containing evenly dispersed reinforcing particles in the aluminum matrix and process for making same.

It is generally known that components for internal combustion engines such as pistons are used under severe physical conditions such as at elevated temperatures as 150° to 400° C. To withstand the hard conditions the components are made of highly heat- and wear-resistant material which has good thermal conductivity and low coefficient of thermal expansion.

On the other hand, there is a strong demand for vehicles to be lightweight which requires individual components to be as light as possible. In addition, they must be easy to machine so as to increase the production efficiency and reduce the cost.

To satisfy such demands the components for internal combustion engines are made of Al—Si alloy made by an I/M method, such as AC8A and AC8B, but these materials are not sufficiently strong at elevated temperatures. For example, the tensile strength thereof is 17 $kgf/mm^2$ at 200° C., and 7 $kgf/mm^2$ at 300° C. As a result, it is difficult to make a thin and lightweight components with these materials.

To overcome the difficulty encountered by Al—Si alloy made by an I/M method, there is a proposal for using another type of Al—Si alloys made by a P/M method but they are costly and is not satisfactory in the heat-resistant property. There is another proposal for using aluminum alloys containing dispersed reinforcing particles of $Al_2O_3$ and SiC in the aluminum matrix. It is found that this reinforced alloys increases the heat-resistant property but disadvantageously shortens the life of a cutting tool because of its excessive hard quality.

OBJECTS AND SUMMARY OF THE INVENTION

Accordingly, an object of the present invention is to provide an aluminum-base composite having enhanced heat- and wear-resistant properties and workability and a process for making same.

Another object of the present invention is to provide an aluminum-base composite adapted for making machine components used under severe physical conditions, and a process for making same.

In achieving these objects the inventors have made the present invention:

According to one aspect of the present invention there is provided a heat-resistant aluminum-base composite which comprises an aluminum matrix of not smaller than 99.0% purity, Si particles whose average diameter falls in the range of 0.1 μm to 100 μm, and $Al_2O_3$ and $Al_4C_3$ particles, the particles being dispersed in the aluminum matrix at a volume percent Vf(Si) for the Si particles and a total volume percent $V_f(Al_2O_3+Al_4C_3)$ for the $Al_2O_3$ and $Al_4C_3$ particles wherein:

$$Vf(Si) \geqq 9\%$$

and $$Vf(Al_2O_3+Al_4C_3) \leqq 20\%$$

and $$Vf(Al_2O_3+Al_4C_3)+Vf(Si) \leqq 40\%.$$

According to another aspect of the present invention there is provided a process of producing a heat-resistant aluminum-base composite, the process comprising mixing an aluminum powder of not smaller than 99.0% purity for matrix with Si particles whose average diameter falls in the range of 0.1 to 100 μm; ball milling the powdery mixture of aluminum and Si particles into a powdery complex, during which the aluminum in the powdery complex is allowed to react with the oxygen in the atmosphere and the carbon in an organic anti-seizure agent added to the powdery complex, thereby dispersing $Al_2O_3$ and $Al_4C_3$ particles in the aluminum matrix at the following volume percents Vf(Si) and $V_f(Al_2O_3+Al_4C_3)$:

$$Vf(Si) \geqq 9\%$$

and $$Vf(Al_2O_3+Al_4C_3) \leqq 20\%$$

and $$Vf(Al_2O_3+Al_4C_3)+Vf(Si) \leqq 40\%.$$

The purity of the aluminum matrix must be at least 99.0%, which is required to secure the high thermal conductivity of the composite.

The reinforcing Si particles serve to achieve the low coefficient of thermal expansion and enhance the wear resistance of the composite. To reduce the weight of the composite the specific weight of the reinforcing particles is preferably not greater than 2.7 of the matrix. To this end Si (specific weight: 2.3) and $B_4C$ (specific weight: 2.5) can be used. However $B_4C$ is as hard as 3700 Hv, thereby shortening the life of a cutting tool. Whereas, Si is as hard as 1200 Hv which is softer than the known hard-alloy cutting tools (about 1800 Hv). Actually the long life of Al—Si alloy cutting tools is generally appreciated. In addition, Si has a thermally conductivity of 0.20 cal/°C·cm·s, and owing to the good conductivity the Al—Si alloy is used for making pistons. Si particles can increase the thermal conductivity of the composite, wherein they are preferably 0.1 to 100 μm in diameter on average. If the diameters of the particles are smaller than 0.1 μm the wear resistance of the resulting composite will become insufficient. Whereas, if they have a diameter of larger than 100 μm the resulting composite will be unsuitable for making components for internal engines because of the possibility that the components are likely to crack during forging. The optimum range is 0.1 to 100 μm for achieving the adequate wear resistance and workability.

The $Al_2O_3$ particles are formed through the reaction of the aluminum reacts with oxygen in the atmosphere while the powdery complex of Al and Si is treated by a ball mill. The $Al_4C_3$ particles are formed through the reaction of the aluminum with the carbon content in an organic anti-seizure agent added to the powdery complex while it is treated by the ball mill.

The amounts of these $Al_2O_3$ and $Al_4C_3$ reinforcing particles are required to fall in the ranges mentioned above so as to achieve the desired heat resistance and low coefficient of thermal expansion. If Vf(Si) is smaller than 9%, it is difficult to obtain the desired low coefficient of thermal expansion. Preferably it is in the range of 10 to 20%. If $Vf(Al_2O_3+Al_4C_3)$ exceeds 20% the resulting composite will become too brittle to forge it into components for internal combustion engines, etc. Preferably it is in the range of 3 to 11%, and more preferably in the range of 3 to 8%. As described above, the Si particles serve to achieve the low coefficient of thermal expansion and increase the wear resistance of the composite. To this end it is required to limit the total amount $Vf(Al_2O_3+Al_4C_3)+Vf(Si)$ to 40%. If it exceeds 40%, the resulting composite will become too brittle to decrease the workability of the composite.

Briefly, the heat-resistant aluminum-base composite of the present invention is produced by obtaining a powdery complex of aluminum and reinforcing particles by a ball mill treatment, and placing the powdery complex in a pressure vessel to degasify it. The degasified powdery complex is hot compacted into a mass which is subjected to hot processing such as hot extrusion, hot forging, or hot rolling as desired. The above-mentioned process is carried out under a batch system. Of course a continuous line process is possible where subsequently to the ball mill process the transporting, degasifying, filling of particles in the pressure vessel, and compacting consecutively follow on the line.

The ball mill process is preferably carried out at an atmosphere in which the concentration of oxygen is controlled to not larger than 1.0%. The amount of $Al_4C_3$ particles forming through the ball milling is adjusted by controlling the amount of an organic anti-seizure agent to be added, wherein the organic anti-seizure agent can be selected from organic solvents such as ethanol.

EXAMPLE (1)

This example was carried out to see the relationship between the heat resistance and forgeability of the composite and the equations $Vf(Al_2O_3+Al_4C_3)$ and $Vf(Al_2O_3+Al_4C_3)+Vf(Si)$.

Aluminum powder having a grain size of 45 μm on average produced by an air atomizing, and Si particles of 98% purity having a grain size of 1 μm were mixed by a mixing apparatus at 2,000 rpm for four minutes at volume percent Vf (Si) varied as shown in Table (1), wherein the total weight was 1 kg.

The mixture was ground by steel balls of 40 kg in total amount, each ball having a diameter of ⅜" at an atmosphere of Ar (argon) in which the concentration of air was adjusted as shown in Table (1). The ball milling continued at 280 rpm for an hour. In this way the specimens were obtained in powder. During the ball mill process ethanol as an anti-seizure agent was added at the rates shown in Table (1). The total volume percent $Vf(Al_2O_3+Al_4C_3)$ are shown in Table (1).

Each of the specimens obtained in this way was filled in a pressure vessel of aluminum at an atmosphere of Ar (argon), and degasified at a vacuum at a pressure of $3\times10^{-3}$ torr for five hours. Then each specimen was pulverized by a hot press at 500° C. at a pressure of 7,000 kgf/cm$^2$ to form a billet, which 7 was extruded into a cylindrical bar at a ratio of 10:1 at a temperature of 450° C.

Each specimen was tested to see how the tensile strength was maintained at 300° C., and what the limiting upsetting percent was at 500° C. The results are shown for comparison with the AC8A-T5 die casting:

TABLE (1)

| Specimen No. | Vf(Si) (%) | $Vf(Al_2O_3+Al_4C_3)$ (%) | Ethanol added (%) | Con. of $O_2$ (%) | σB 300° C. (kgf/mm$^2$) | Limiting Upsetting 500° C. (%) |
|---|---|---|---|---|---|---|
| Comp. 1 | 0 | 6 | 40 | 0.1 less | 21 | 65 |
| 2 | 0 | 19 | 40 | 1.0 | 30 | 55 |
| 3 | 0 | 23 | 80 | 1.0 | 34 | 25 |
| Inv. 4 | 15 | 9 | 80 | 0.1 less | 28 | 58 |
| 5 | 25 | 11 | 80 | 0.1 less | 31 | 53 |
| Comp. 6 | 35 | 10 | 80 | 0.1 less | 36 | 20 |
| $AC8T-T_5$ | | | | | 7 | 67 |

(Note) Comp. stands for comparative specimen.

It will be appreciated from Table (1) that the specimens containing $Al_2O_3$ and $Al_4C_3$ dispersed particles is superior in heat resistance to the $AC8A-T_5$ die casting. However, if $Vf(Al_2O_3+Al_4C_3)$ exceeds 20% like specimen No. 3, and $Vf(Al_2O_3+Al_4C_3)+Vf(Si)$ exceeds 40% like specimen No. 6, the limiting upsetting percent is as poor as 25% and 20%, respectively, the forging is almost impossible.

EXAMPLE (2)

This experiment was carried out to see the relationship between Vf(Si) and the coefficient of thermal expansion of the composite.

In obtaining the specimens Nos. 7 to 10 the values of Vf(Si) were varied as shown in Table (2) and the ball milling was carried out under the same conditions as in Example (1) except that $Vf(Al_2O_3+Al_4C_3)$ was set to not larger than 6% wherein the concentration of oxygen in the atmosphere of Ar (argon) was below 0.1% and the added ethanol was 40 cc. The process of obtaining the specimens was the same as that of Example (1).

The specimens were examined on their coefficients of thermal expansion, and compared with the $AC8A-T_5$ die casting. The results are shown in Table (2):

TABLE (2)

| Specimen No. | Vf(Si) (%) | Coefficient of Thermal Expansion ($10^{-6}$/°C.) |
|---|---|---|
| comp. 7 | 0 | 23.9 |
| 8 | 5 | 22.4 |
| Inv. 9 | 9 | 19.9 |
| 10 | 15 | 18.0 |
| $AC8T-T_5$ | — | 19.5 |

It will be appreciated from Table (2) that when Vf(Si) is smaller than 9%, the coefficient of thermal expansion will become large, and that when it is not smaller than 9% the specimens have the same as or a larger coefficient of thermal expansion than the AC8A-$T_5$.

EXAMPLE (3)

This experiment was carried out to see the relationship among the average grain size of Si particles, the resulting wear resistance and forgeability.

In obtaining the specimens Nos. 11 to 16 the average grain sizes of Si particles were varied as shown in Table (3), and the ball milling was carried out under the same conditions as in Example (1) except that $Vf(Al_2O_3+Al_4C_3)$ was set to 6% wherein Vf(Si) was 15%, with the concentration of oxygen in the atmosphere of Ar being below 0.1% and the added ethanol being 40 cc. The specimens were obtained in the same manner as Example (1).

The specimens were examined with respect to the specific wearing amounts and limiting upsetting percents at 500° C., and compared with the AC8A-$T_5$ die casting. The wear resistance was tested by an Ohgoshi testing machine wherein no lubricant was used, the mating piece was FC30, the abrading speed was 1.99 m/s, and the abrading distance was 600 m, and the final load was 2.1 kg. The results are shown in Table (3):

TABLE (3)

| Specimen Nos. | | Si particles diameter (μm) | Specific Wearing Amount ($mm2 \cdot kg^{-1}$) | Limiting Up-Setting 500° C. (%) |
|---|---|---|---|---|
| comp. | 11 | 0.05 | 51 | 65 |
| Inv. | 12 | 0.1 | 34 | 66 |
| | 13 | 1.0 | 30 | 63 |
| | 14 | 10.0 | 28 | 57 |
| | 15 | 100.0 | 20 | 50 |
| comp. | 16 | 200.0 | 19 | 27 |
| AC8T-$T_5$ | | — | 35 | 67 |

It will be noted from Table (3) that when the average grain size of Si particles is smaller than 0.1 μm, the resulting specific wearing amount become large, which means a decreased wear resistance, and that when it exceeds 100 μm, the limiting upsetting percents become low, which means a decreased forgeability.

EXAMPLE (4)

This experiment was carried out to see the relationship between the purity of aluminum used for the matrix and the thermal conductivity of the specimens.

In obtaining the specimens Nos. 11 to 16 the purity of aluminum was varied as shown in Table (4), and the experiment was carried out under the same conditions as in Example (1) except that $Vf(Al_2O_3+Al_4C_3)$ Vf(Si) was set to 6% wherein Vf(Si) was 15%, with the concentration of oxygen in the atmosphere of Ar being below 0.1% and the added ethanol being 40 cc. The specimens were obtained in the same manner as Example (1).

The specimens were examined on their thermal conductivity, and compared with the AC8A-$T_5$. The results are shown in Table (4):

TABLE (4)

| Specimen No. | | Purity of Al (%) | Thermal Conductivity ($cal/cm^2 \cdot °C. \cdot s$) |
|---|---|---|---|
| comp. | 17 | 99.99 | 0.35 |
| | 18 | 99.0 (A1100) | 0.32 |
| Inv. | 19 | 97.1 (A3003) | 0.27 |
| | 20 | 96.6 (A6061) | 0.24 |

TABLE (4)-continued

| Specimen No. | Purity of Al (%) | Thermal Conductivity ($cal/cm^2 \cdot °C. \cdot s$) |
|---|---|---|
| AC8T-$T_5$ | | 0.29 |

It will be appreciated from Table (4) that when the purity of aluminum is smaller than 99%, the specimens have a low thermal conductivity than the AC8A-$T_5$ specimen, and that when it is equal to or larger than 99%, they have a higher thermal conductivity than the AC8A-$T_5$.

EXAMPLE (5)

This experiment was carried out to see the specific weight of the specimen No. 10 of Table (2) and the life of a cutting tool affected by it, and the results are shown in Table (5) for comparison with the AC8A-$T_5$ specimen. The cutting test was conducted under the following conditions:

The length of a specimen: 23 mm (diameter)×200 mm

| | |
|---|---|
| Cutting Tool: | K10 |
| Cutting Speed: | 247 m/s |
| Feed: | 0.2 mm/rev. |
| Depth of Cut: | 1 mm |
| Number of Cutting: | 8 times |
| Lublicant: | Not used |

The widths of wear on the clearance surface of the cutting tool were measured. The results are shown in Table (5):

TABLE (5)

| Specimen No. | Specific Weight | Specific Wearing Amount (μm) |
|---|---|---|
| Inv. 10 | 2.66 | 28.0 |
| AC8T-$T_5$ | 2.72 | 55.0 |

It will be appreciated from Table (5) that the specimen No. 10 has a lighter specific weight than the AC-8A-$T_5$, and that it abrades the cutting tool less than AC8A-$T_5$ does.

What is claimed is:

1. A heat-resistant aluminum-base composite which consist essentially of an aluminum matrix of not smaller than 99.0% purity, Si particles whose average diameter falls in the range of 0.1 μm to 100 μm, and $Al_2O_3$ and $Al_4C_3$ particles, the particles being dispersed in the aluminum matrix at a volume percent Vf(Si) for the Si particles and a total volume percent $V_f(Al_2O_3+Al_4C_3)$ for the $Al_2O_3$ and $Al_4C_3$ particles wherein:

$$Vf(Si) \geqq 9\%$$

and $$Vf(Al_2O_3+Al_4C_3) \leqq 20\%$$

and $$Vf(Al_2O_3+Al_4C_3)+Vf(Si) \leqq 40\%.$$

2. A heat-resistant aluminum-base composite as defined in claim 1, wherein the Vf(Si) is in the range of 10 to 20%.

3. A heat-resistant aluminum-base composite as defined in claim 1, wherein the $Vf(Al_2O_3+Al_4C_3)$ is in the range of 3.0 to 11%.

* * * * *